United States Patent [19]

Gamper

[11] Patent Number: 5,025,820

[45] Date of Patent: Jun. 25, 1991

[54] SELF-ADJUSTING COLLAPSIBLE CRUTCH

[76] Inventor: William B. Gamper, 3064 Ramsgate Rd., Rancho Cordova, Calif. 95628

[21] Appl. No.: 597,838

[22] Filed: Oct. 15, 1990

[51] Int. Cl.[5] ..... A61H 3/02

[52] U.S. Cl. ..... 135/69; 135/72; 135/75; 272/70; 248/188.5; 248/297.3

[58] Field of Search ..... 135/68, 69, 71–73, 135/75; 272/70, 70 A, 70.3, 70.4; 248/188.5, 188.8, 297.3

[56] References Cited

U.S. PATENT DOCUMENTS

| | | | |
|---|---|---|---|
| 2,172,047 | 9/1939 | Jacobucci | 135/69 |
| 2,264,015 | 11/1941 | Bennett | 135/69 |
| 2,426,074 | 8/1947 | Watters | 135/69 |
| 2,544,957 | 3/1951 | Henry | 135/69 |
| 2,554,653 | 5/1951 | Wisecarver | 135/68 |
| 3,730,198 | 5/1973 | Johnston et al. | 135/69 |

FOREIGN PATENT DOCUMENTS

| | | | |
|---|---|---|---|
| 2310986 | 9/1974 | Fed. Rep. of Germany | 135/72 |
| 1101212 | 10/1955 | France | 135/72 |
| 103635 | 2/1917 | United Kingdom | 135/69 |
| 124911 | 4/1919 | United Kingdom | 135/69 |

*Primary Examiner*—David A. Scherbel
*Assistant Examiner*—Lan Mai
*Attorney, Agent, or Firm*—Mark C. Jacobs

[57] ABSTRACT

A self-adjusting crutch containing a central portion having both a fixed and a moveable central post, one of which nests within the other. A prepositionable height fastener cooperates with a coupling collar, both of which are disposed on the central portion to predetermine the amount of extension. When the fastener and coupler are in cooperation, the leg can be extended and retracted repeatedly the exact same distance.

An improved hand grip is also disclosed.

14 Claims, 4 Drawing Sheets

SELF-ADJUSTING COLLAPSIBLE CRUTCH

BACKGROUND OF THE INVENTION

Within the last hundred years there have been numerous attempts to develop collapsible crutches. For the most part, these crutches while collapsible require significant time and effort to reduce them in elongation. Some of these feature a telescoping tubular lower member wherein the inner section is retained as by a cross bolt and nut within a slightly wider outer section. For these it is necessary for the user to sit down in order to collapse the crutch for ready temporary storage as in a restaurant, theater or other public place. Once collapsed, when the event at which the user has been in attendance is over, again significant effort must be exerted to re-extend the telescoping leg to its desired position. Oftentimes it is next to impossible to relocate the exact length of the telescoping member in order to determine the desired elongation of the crutch.

There is a need therefore for a self-adjusting collapsible crutch. It is an object therefore of this invention to provide a self-adjusting collapsible crutch.

It is yet another object to provide a collapsible crutch that can be closed while the user is in either the standing or sitting position.

It is yet another object to provide a crutch that needs no tools for extension and reduction in elongation.

Still another object is to provide a lightweight easy to collapse crutch.

A still further object is to provide a collapsible crutch with an improved support handle.

This and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

KNOWN PRIOR ART

As a result of a patent novelty search, applicant is aware of the following references:

| | |
|---|---|
| 2,426,074 | Watters |
| 2,264,015 | Bennett |
| 1,156,747 | Briscoe |
| 2,544,957 | Henry |
| 2,641,491 | Mueller |
| 4,182,364 | Gilbert |

The subject matter of the claims set forth below is not disclosed nor is it obvious from any of the references cited above, alone or in combination with each other.

SUMMARY OF THE INVENTION

A self-adjusting height crutch which contains a central portion having both a fixed and a moveable central post, one of which nests within the other. A prepositionable height fastener cooperates with a coupling collar, both of which are disposed on the central portion to predetermine the amount of extension of the moveable central post. When the height fastener has been located and the coupler are in and out of cooperation, the leg can be extended and retracted repeatedly the exact same distance.

A hand grip featuring improved gripability is also disclosed.

DESCRIPTION OF THE PREFERRED EMBODIMENT

The crutch of this invention is seen to be formed of a pair of spaced lateral fixed posts which are retained in an arm piece at their upper end, and in a base boot at their lower end. Intermediate these posts is a central portion comprised of a nestable fixed post and a moveable post coupled together, with the moveable post projecting through the base boot for contact with the ground.

Figure 1:
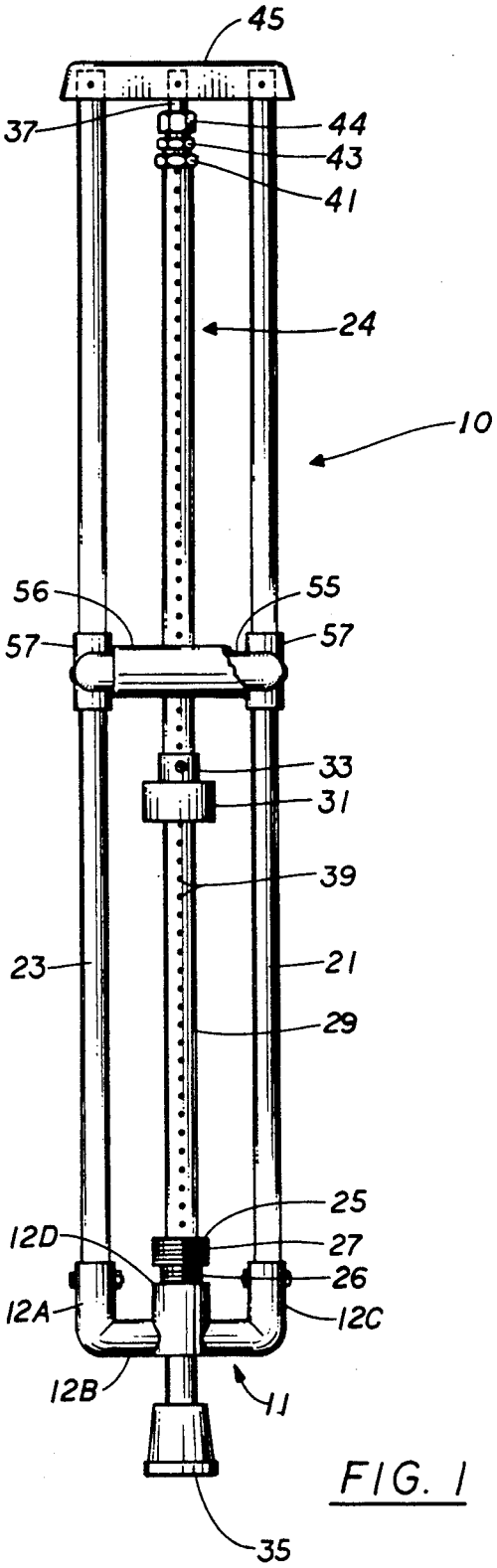
FIG. 1 is a front elevational view of this invention with the moveable central post retracted.
Figure 2:
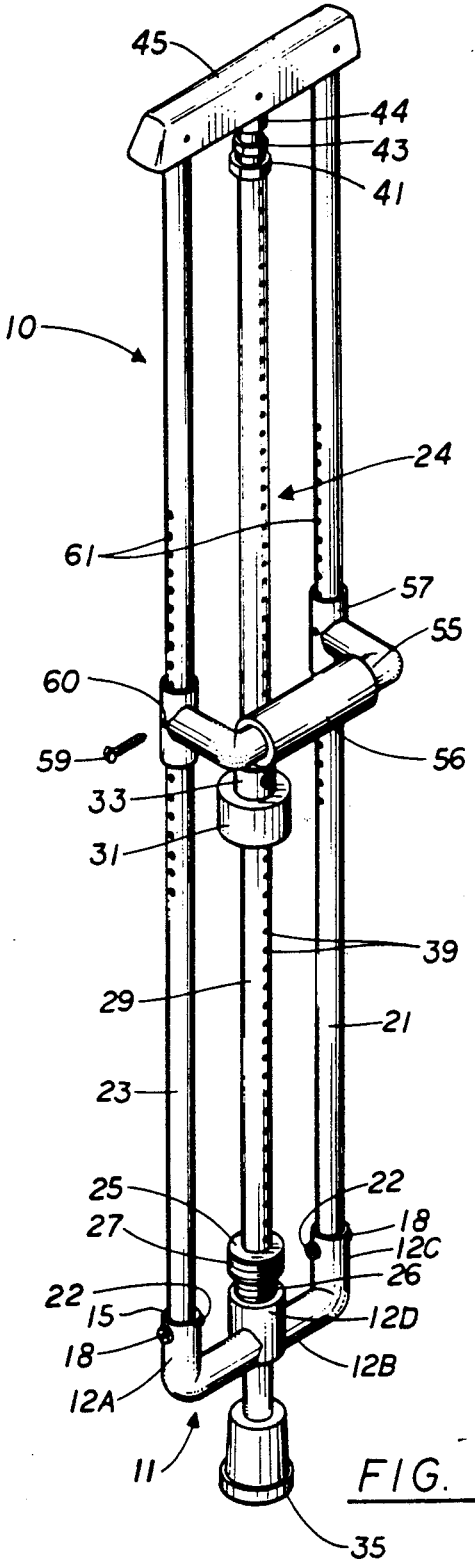
FIG. 2 is a side perspective view thereof.

Turning now to FIG. 1 and 2, there is shown the crutch 10, of this invention. The crutch 10 features an arm piece 45, (which will be described in detail infra with respect to the discussion of FIG. 4), from which descend two spaced lateral posts 21, 23. These are of a fixed length, of about 34" in length, and constructed of tubing about 0.75 to 1" in diameter and extend from the arm piece at their upper ends to locations on the base boot at their respective lower ends.

Figure 6:
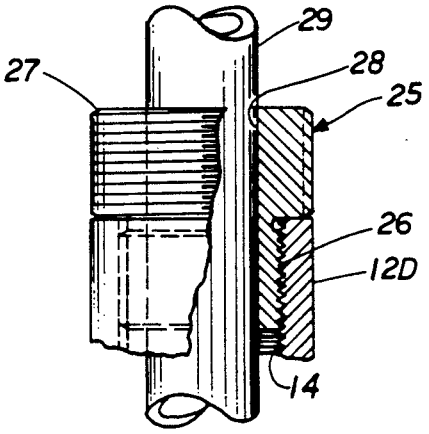
FIG. 6 is an enlarged close-up partially sectional view of a detail shown in FIG. 5.

A central portion 24 is disposed with the arm piece 45, at its upper end with an extension coupler 25 which engages the base boot 11 at its lower end, details of the central portion will be held in abeyance until after the discussion of the base boot, in order to obtain a basic understanding of the construction of the crutch of this invention. See also FIG. 6.

Base boot II is a generally W-shaped member with a trio of upwardly extending arms, the outer of which may be taller than the center arm. Boot 11 includes what will arbitrarily be referred to as a left arm 12A, extending upwardly from a base 12B. Spaced from arm 12A and extending upwardly on the opposite end of base 12B is a similar right arm 12C. Intermediate these two arms is a central arm 12D. Each of these arms is tubular and the base 12B may be tubular but need not be so. The diameter of the central arm is greater than that of the lateral arms 12A, 12C, for reasons that will appear obvious from the discussion below.

Figure 5:
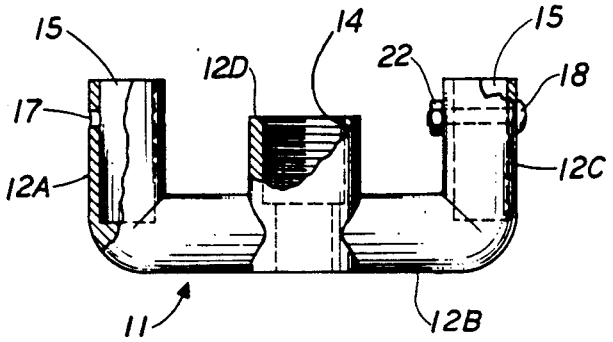
FIG. 5 is a close-up exploded view of an intermediate area of this invention.

Boot 11's details may be seen in FIG. 5. Thus each lateral arm 12A, 12C includes a top opening 15, while center arm 12D includes a top interior threaded opening 14. A cross bore 17 extends through each lateral arm 12A, 12C at a disposition to be aligned with a bore (not seen) through each lateral arm 12A, 12C near the lower end thereof (a lateral arm being disposed in each arm of base boot II). A bolt 18 extends through each bore 17, of the lateral arms 12A, 12C and the unseen counterpart bores in the lateral arms 21, 23. The bolts are retained by nuts 22, per FIG. 2. While only one bolt and nut combination 18, 22 is shown associated with each lateral arm, at least one extra bore 17 may be placed in each of arm and in each lateral post such that additional bolts and nuts may be utilized for extra rigidity.

As noted previously, central arm 12D is internally threaded 14, to receive the second, i.e. lower threads 26 of the annular cylinder shaped extension coupler 25. See also FIG. 6.

Figure 9:
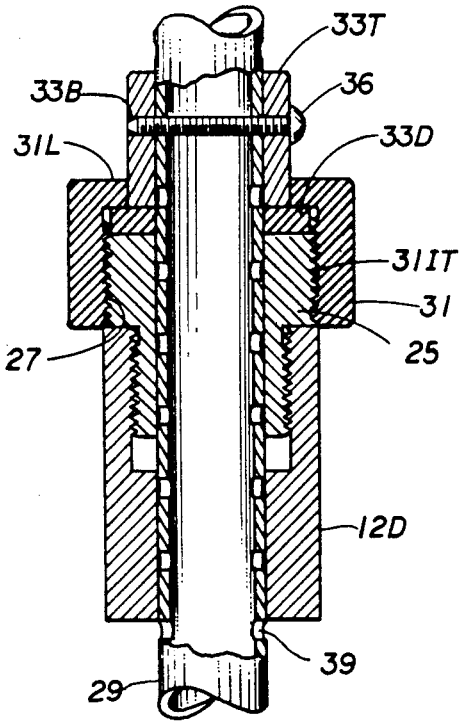
FIG. 9 is another close-up of a different part of the central post of this invention.

Extension coupler 25, which has a vertical central opening 28 therethrough, also includes an area of greater diameter upon which are the upper outside threads 27 to matingly engage coupling collar 31's interior threads 31IT as seen in the outaway area of coupler 31 in FIG. 9.

Figure 3:
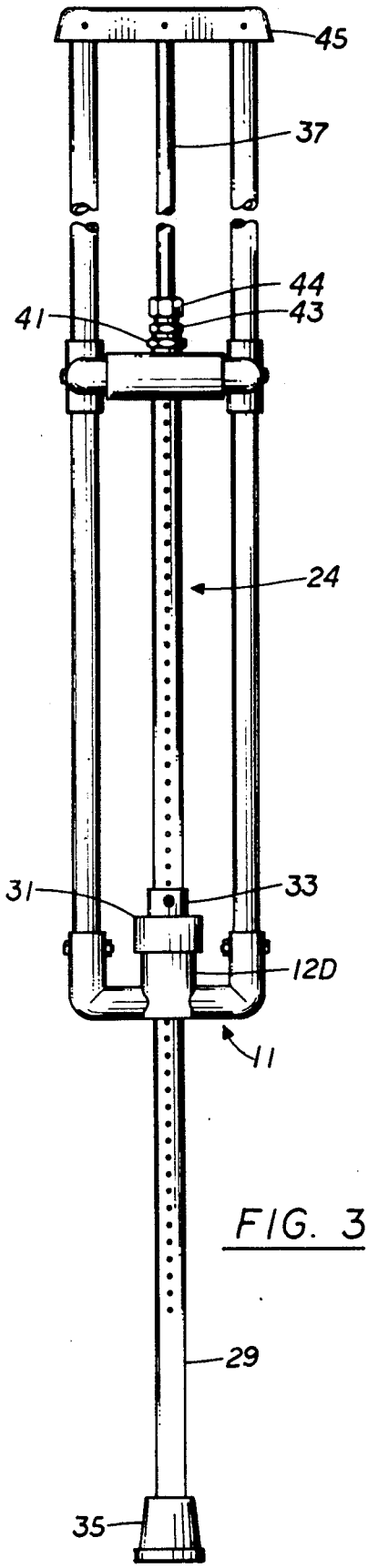
FIG. 3 is a view similar to FIG. 1 with the moveable central post in an extended position.

The discussion moves now to the central portion 24. As shown it comprises a fixed or stationary inner post 37 nesting within a moveable outer post 29. Reference is made to FIGS. 1, 2, and 3. The inner post may comprise a tubular member of about ½ to ¾ inch outside diameter, while the outer post may comprise a tubular member of from ¾ to 1 inch outside diameter. One or both may be metal such as aluminum or plastic such as polycarbonate.

The outer central post 29 features a plurality of vertically spaced height adjustment bores 39 on at least one quadrant of the tubular member. These bores may also comprise throughbores, and as such would be found on two quadrants of the perimeter of the moveable post. Further details of the moveable outer post are recited below.

These height adjustment bores are utilized by the height adjustment fastener 33, which comprises a tubular member 33T-per FIG. 9 having a disc washer 33D with a greater outside diameter than the opening in 33T on its underside. The opening in the tubular member 33T and the disc washer 33D are of the same diameter. Elements 33T and D may be made integrally as by plastic molding or one may be adhered or otherwise secured to the other.

The diameter of disc 33D is sized to be small enough to pass through the interior of coupling collar 31, but wide enough to permit the inward extending top lip 31L of coupling collar 31 to rest thereupon.

The height adjustment fastener also includes a bore through the wall of the tubular section 33T which bore is designated 33B, see FIG. 9. This bore receives self-tapping screw 36, per FIG. 3 for insertion into one of the height adjustment bores 39. Such insertion constitutes the mode of presetting the height adjustment of the moveable leg of the crutch for a limit of its downward travel.

Coupling collar 31 is a tubular section in configuration and includes an inward extending circumscribing lip 31L per FIG. 9. Coupling collar 31 also includes internal threads 311T which threadedly engage exterior threads 27 of coupler 25.

Returning now to FIGS. 1, 2, and 3 it is seen that the upper end of the moveable central post 29 is closed off by a valve receiver 41, which valve receiver has a friction fitting barrel disposed into the open end of the moveable central post 29. Of course, this valve receiver 41 may be adhered or otherwise secured therein as by a crosspin not shown. This valve receiver 41 is open at the top and is internally threaded to receive compression valve 40's valve body 43's lower threads 43'. Valve body 43's upper threads 43" are engaged by lock nut 44, per FIG. 8.

As is seen the fixed post 37 of the central portion passes readily through the lock nut 44 and the compression valve body 43 and the valve receiver 41 into the interior of the moveable central post 39.

A conventional split compression sleeve 38 while shown spaced slightly distant from threads 43" does in fact rest in an internal chamber within the upper portion of 43. However the opening 44' of the lock nut 44 is sized in diameter such that it does not permit passage of said sleeve 38 therethrough.

Thus, when the nut 44 is threadedly engaged to upper threads 43", the tightening of the lock nut 44's opening 44' on the sleeve 38 causes the compression sleeve to bind onto the fixed post 37 at the location of the sleeve on the fixed post via the action of the internal chamber within 43 forcing the sleeve to tighten on the post 37.

Contrast the relative positioning of the moveable post in FIGS. 1 and 3. The binding previously discussed limits the upward mobility of the moveable post and retains the moveable post in a fixed position at the exact extension of the moveable post as is desired by the crutch user.

Figure 4:
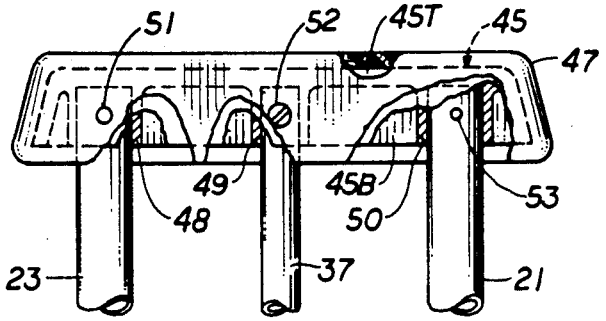
FIG. 4 is a close-up view of the top area of this invention.

Turning now to the details of FIG. 4, one sees the connection of the three posts to arm piece 45. Arm piece 45 is of a generally rectangular configuration having spaced front and rear walls and spaced side walls and having an open bottom 45B and a solid top wall 45T. Depending down from the top wall within the interior are a trio of aligned tubular post receivers 48, 49 and 50. Naturally receiver 49 is of a small diameter since the fixed post 37 that fits therein is of a smaller diameter than the lateral posts. Each post receiver is on slightly larger in diameter than the post it receives in order to achieve a snug friction fit. Each post receiver 48, 49, and 50 has a cross bore 51 to receive self-tapping screws 52 for insertion into bores 53 at the upper end of each respective post 21, 23, and 37, which bores 53 are in axial alignment with their respective bores 51. These screws 52 retain the posts in the arm piece. Arm piece 45 is protected by arm piece cover 47 which is made of cloth or rubber and which fits over the arm piece 45 as is known in the art. See FIG. 4.

Figure 7:
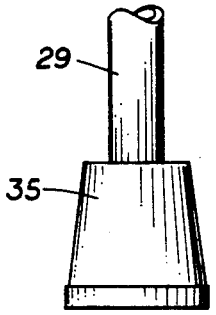
FIG. 7 is a close-up elevational view of a detail shown in FIG. 1.

FIG. 7 depicts a view of part of the moveable central post 29 with a conventional rubber foot 35 mounted thereon. This may be by friction fit, Velcro ® or adhesive, all of which are again traditional in the crutch art.

Figure 10:
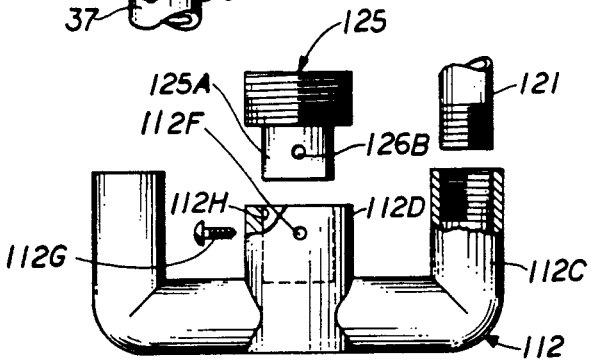
FIG. 10 is an elevational view of a variant in the construction of this invention.

In FIG. 10 there are shown several variants in the construction of the crutch. Here the base boot is designate 112 with one outer arm designated 112C. This arm is threaded adjacent its opening to threadedly engage the threads of lateral post 121. One of the threads would be external and the other internal. The choice is a designer's choice. Center arm 112D includes a bore 112F to receive a self-tapping screw 112G shown rotated out of position for purposes of illustration for insertion into a bore 126B of a modified coupler 125 the lower end of which, 125A, fits within bore 112H.

Referring now to FIGS. 1, 2 and 3, it is seen that a pair of tubular T-hand grip retainers 57 are mounted at the same elevation on each of the lateral posts via self-tapping screws 59 being inserted into bores 60, which bores align with other bores not seen in each lateral post. A generally U-shaped hand grip 55 is attached by any convenient method to the retainers 57 or they may be integrally formed. The outward extending section of each T may be of any suitable shape to be engaged by or attachable to the arms of the U-shaped hand grip 55. A cover 56 of soft rubber may be disposed over the intermediate section of the U-shaped handgrip 55.

Figure 11:
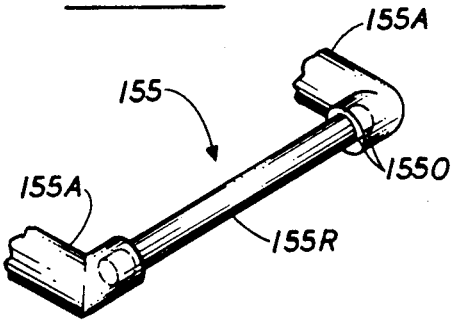
FIG. 11 is a close-up view of the preferred handgrip forming part of this invention.
Figure 17:
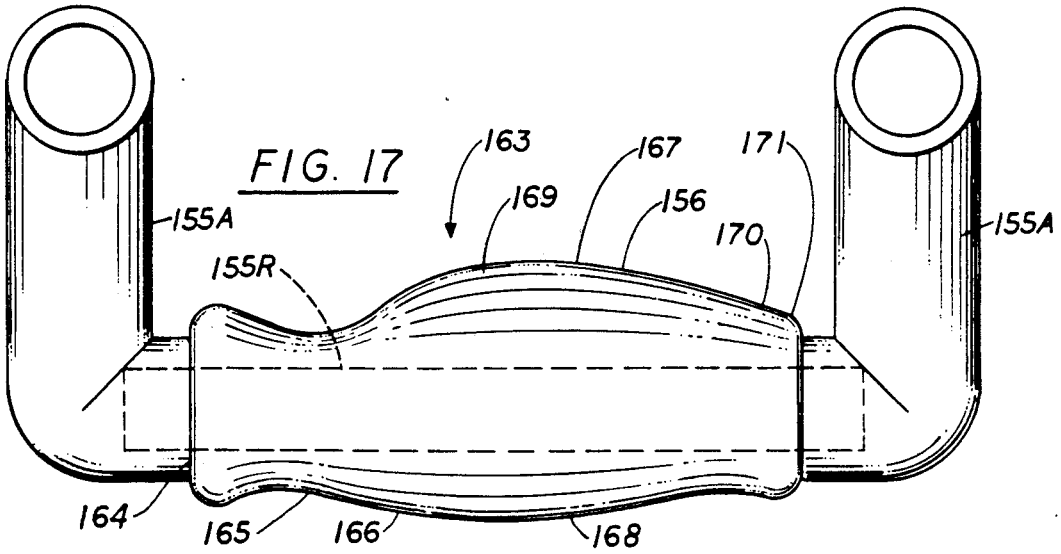
FIG. 17 is a top plan view of an improved handgrip cover employable as part of this invention, shown mounted on a handgrip.

A preferred handgrip 155 is shown in FIG. 11. Here the handgrip includes a pair of L-shaped arms 155A having opposed openings 1550 into which is disposed a rotatable rod 155R. Disposed over rod 155R and best seen in FIG. 17 is a new contoured cover 156 which is fixedly attached to rotatable rod 155R to thereby provide maximum hand comfort. More details on this cover member are provided below.

If desired a series of bores 61 (see FIG.2) may be placed in each lateral post in aligned pairs such that the location of the handgrip may be varied upwardly or downwardly as may be desired.

Whereas the handgrip 55 shown in FIGS. 1, 2 and 3 is a fixedly disposed handgrip, the handgrip 155 in FIG. 11 is a rotatable one. In FIG. 17 there is shown a new hand grip cover 163 which may be adapted to replace the 56, by utilizing the specifically sculpted configuration of the cover of FIG. 17 to replace the soft rubber tubular member 56.

This improved asymmetric grip cover 163, which is somewhat tubular features a rear edge 164 of a first diameter. The grip then uniformly tapers narrowingly at first portion 165, to an outwardly uniformly tapering second portion 166. The third portion is an unsymmetrical bulbous portion 169 having an arcuate inner edge 167, and a relatively flat outer edge 168. This unsymmetrical portion 169 is bulbous along edge 167, such that the cover extends beyond the diameter of edge 164 along edge 167, but not so along edge 168. This third portion 169 is also bulbous in a downwardly direction as well as per FIG. 3, but not the same extent. A fourth portion 170 of a smaller diameter is interposed between the third portion and a fifth portion 17*i*. The fourth portion tapers outwardly slightly to join the fifth portion.

It is seen therefore that two slight recesses are formed for the natural disposition of the hand; namely between the first and third portions and between the third and fifth portions. The angle of the grip 63 cover 163 to the central post coincides with the approximate angle of the body's skeletal structure at rest at the user's side. Thus this grip conforms naturally to the body structure thus enabling the arms to reduce the weight upon the underarms by the natural downward pressure applied on the grips by the user.

As can be appreciated there is a left hand and a right hand model of the cover 163. In use, the fifth finger falls into the crevice at the second portion, as does the fatty part of the palm of the hand. The fifth finger helps to stabilize the crutch against rotations thereof. The second and third fingers rest upon edge 167 of the third portion. These fingers help hold the crutch steady. The thumb falls over the top of the grip in the recess at the fourth portion and meets the index finger to lock the grip to the user's hand.

Figure 12:
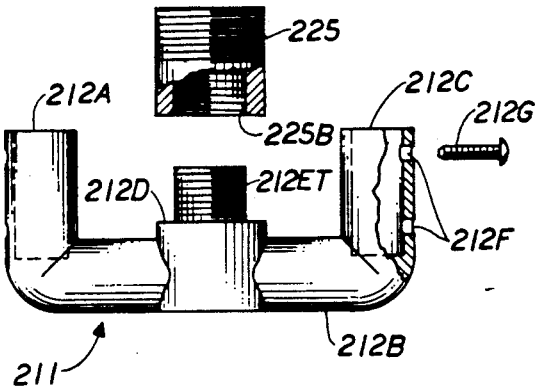
FIG. 12 is an elevational view of another variant in the same portion of the invention as FIG. 10.

Let us turn now to FIG. 12 which depicts another variant in the construction of a portion of this invention; namely, the base boot which here is designated 211. The upstanding arms serve the same function as previously described and are designated 212A, 212C, and the central one is 212D. All of these extend from base 212B. In this embodiment, the exterior arms include at least one, and as shown a pair of, bores 212F to receive self-tapping screws 212G or equal to secure lateral posts therein. Of course this presupposes that such lateral posts have been predrilled with suitable apertures that align with bores 212F.

The other change in this variant in construction is the use of internal threads in the lower end of base 225, said threads being 225B in FIG. 10, and which threads engage external threads 212ET on arm 212D. In all other aspects coupler 225 is the same as coupler 25.

Figure 13:
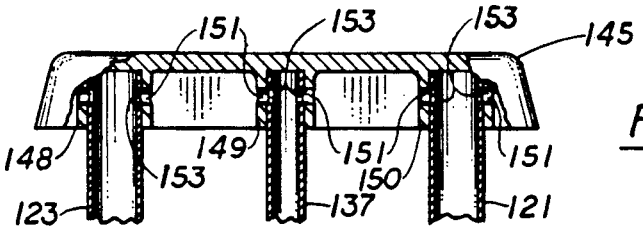
FIG. 13 is a front elevational close-up view similar to FIG. 4 that illustrates a variant in the construction of this area of the device of this invention.
Figure 14:
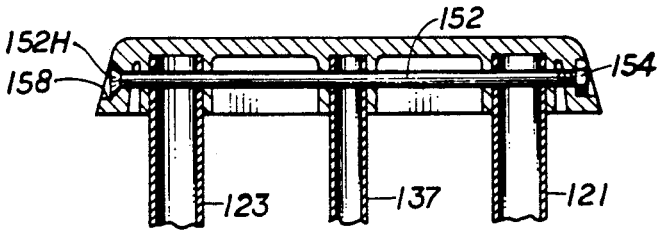
FIG. 14 is a perspective view, partially cutaway, of the variant shown in FIG. 13 of the top area of the device of this invention.

The discussion now turns to alternative means of attaching the 3 posts to the arm piece 145, as is shown in FIGS. 13 and 14. In FIG. 13, arm piece 145 is seen to have 3 post receiving tubes 148, 149 and 150. Each of these tubes has a pair of aligned bores 180 degrees apart, each bore being designated 151. The bores 151 are all horizontally aligned.

Each post 121, 123 and 127 also has a pair of 180 degree spaced bores 153, all six of which are horizontally aligned. As seen in FIG. 14, threaded pin 152 is disposed through opening 158 of arm piece 145 such that its flat head 152H is countersunk into the arm piece. Pin 152 extends through all bores 151 and all bores 153 to retain each of the three posts in a fixed position in the post receiving tubes, pin 152 is retained in position by nut 154.

Figure 8:
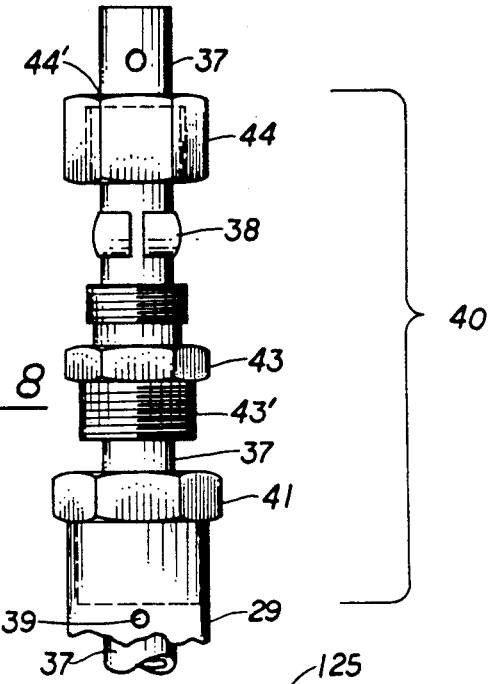
FIG. 8 is a close-up exploded view of a part of the central post of this invention.
Figure 15:
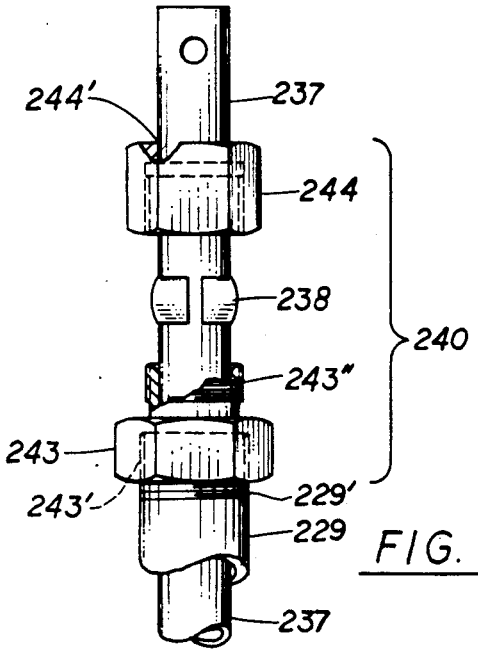
FIG. 15 is an exploded view of a variant of the portion of the central post shown in FIG. 8. Hereto, the view is a close-up.
Figure 16:
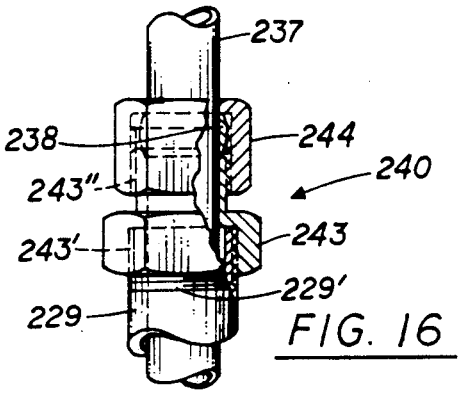
FIG. 16 is a view similar to FIG. 15 but showing the compression valve component assembled in a fixed and locked position. Part of this figure is in cutaway to show internal portions of the valve.

The discussion now turns to FIG. 15, and FIG. 16 which depict a variant in the construction shown in FIG. 8. FIG. 15 depicts the variants components unengaged, while in FIG. 16 they are engaged. Here too it is seen that the upper end of the moveable post 229 is closed off by a compression valve 240 comprised of a valve body 243, a sleeve 238 and a lock nut 244, with the valve body 243 here being directly disposed in moveable post 229, thereby eliminating the need for a valve receiver 41 as seen in FIG. 8. The valve body's lower threads 243' are internal and are threadedly engaged to external threads 229' of moveable post 229. The valve body's upper threads 243" are engaged by lock nut 244, per FIG. 15. As is seen the fixed post 237 passes readily through the lock nut 244, (FIG. 16) and the compression valve body 243 into the interior of the moveable central post 229. Sleeve 238 while shown spaced slightly distant from threads 243" again for purposes of illustration, in fact rests in an internal chamfer within the upper portion of 243 as may again be seen in FIG. 16 in the area of the cutaway. But said sleeve 238 can not pass through the opening 244' of the lock nut 244. Thus the tightening of the lock nut 244's opening 244' on the conventional compression sleeve, 238, when the lock nut is threadedly engaged to upper threads 243" causes the compression sleeve to bind onto the fixed leg at the then specific location of the valve 240 relative to the fixed post by way of the action of the internal chamber within 243 forcing the sleeve to tighten on the fixed post as can be seen in FIG. 16. Such binding which is known to the art, limits the upward mobility of the moveable post and retains the moveable post in a fixed position relative to the fixed post, i.e. the exact extension of the moveable post to be used by the crutch user.

ADJUSTMENT OPERATION

Reference is made again to FIGS. 1, 2, and 3. FIGS. 1 and 2 show the crutch 10 of this invention in the closed or storage position, while FIG. 3 shows it in its extended or use position. In the first or stored position, the lock nut 44 is tightened against the compression valve at the junction of the fixed central post 37 with the arm piece 45. Coupling collar 31 will rest on the disc 33D (see FIG. 9) of the height adjustment fastener 33 wherever that has been preset as previously discussed.

In order to utilize the crutch, the lock nut 44 is loosened; the crutch held vertically to permit the moveable central post 29 to move downwardly through the coupler 25 until the disc 33D disposed on the moveable central post 29 comes to rest upon coupler 25. The user then holds the crutch up at a convenient height, but vertically with one hand and then couples the coupling collar 31 to coupler 25 by engaging the threads of the coupler to those of the collar. The lock nut 44 is then retightened on to the compression valve 40 to secure the moveable central post 29 relative to the fixed central post 37.

To return the crutch to the storage position, the procedure is merely reversed.

It is seen that any suitable materials such as plastic or metal or wood, as employed in conventional crutches, may be employed for the crutch of this invention.

It is seen that by selectively securing the height fastener to the moveable central post, the maximum travel downward of the moveable post through the collar is defined every time as that predetermined amount. The disc 33D of the fastener impacts the coupler at the point of maximum travel. This permits the collar 31 which rests upon the disc to threadedly engage the coupler's external threads to retain the moveable post at a set location relative to the fixed post.

It is of course recognized that the variants disclosed herein can be utilized in a mix and match situation. Thus the pivotable handle of FIG. 11 may be employed with either the construction of FIG. 8 or with the construction of FIG. 15 for example.

The reader should understand that certain screws and/or bolts have been shown in the drawings adjacent the bore they fit into in order to render the drawings easier to understand. Reference is made for example to FIGS. 2, 12 and 12.

It is also to be appreciated that the underside of the grip 163 which is not shown in FIG. 17 is similar to the upper surface that is shown in that figure.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In an adjustable crutch having an arm piece, and a base boot, with a pair of spaced fixed lateral posts disposed on one end in the arm piece and on the other end in the base boot, the improvement comprising in combination:

(a) a base boot having a central arm having a vertical throughbore, in which throughbore is disposed, (b) an annular cylindrical coupler, said coupler having a central opening therethrough and being of a diameter large enough for a central portion to pass therethrough, said coupler having an outside threaded area;

(c) a longitudinally adjustable central portion comprising a fixed central post disposed at one end in said arm piece and being nestable within a moveable central post, and the moveable central post being disposed through said coupler's central opening;

(d) a coupling collar having a central opening therein, said collar encircling said central portion and freely moveable therealong, said coupler having internal threads for threaded engagement with the outside threads of said cylindrical coupler;

(e) a height adjustment fastener selectively securable to said moveable central post, said adjustment fastener having movement limiting means thereon which means cooperates with said collar for preventing movement of said collar past said fastener and causing said collar to rest on said means;

(f) locking means on said moveable central post for releasably securing said moveable central post relative to said fixed central post;

whereby when said crutch is in a first closed position with the moveable central post secured by said locking means proximate the arm piece, and said fastener is selectively secured at a desired location on said moveable post, the coupling collar rests on said fastener, and when it is desired to use said crutch, the locking means is released causing the moveable central post to pass through said coupler until the fastener impacts said coupler such that the collar can be threadedly engaged to said coupler; and said locking means is relocked at a point distant from said arm piece.

2. The crutch of claim 1 further including hand grip retainer means mounted on said lateral posts and a handgrip.

3. The crutch of claim 2 wherein the hand grip is rotatably mounted within said hand grip retainer means.

4. The crutch of claim 3 wherein the handgrip receivers are fixedly adjustably positionable with respect to said lateral posts.

5. The crutch of claim 3 including an asymmetric cover for the rotatable handgrip.

6. The crutch of claim 5 including an asymmetric cover for the rotatable handgrip, which cover is somewhat tubular and features a rear edge of a first diameter, from which the handgrip then uniformly tapers narrowingly to a first portion, then to an outwardly uniformly tapering second portion, with the third portion being an unsymmetrical bulbous portion having an arcuate inner edge, and a relatively flat outer edge, wherein said unsymmetrical portion is bulbous along its interior edge, such that the asymmetrical portion extends beyond the diameter of said first edge along its interior edge but not so along its exterior edge; a fourth portion of a smaller diameter is interposed between the third portion and a fifth portion, said fourth portion tapering outwardly slightly to join the fifth portion.

7. The crutch of claim 2 including an asymmetric shaped handgrip.

8. The crutch of claim 7 including an asymmetric handgrip, which handgrip is somewhat tubular and features a rear edge of a first diameter, from which the handgrip then uniformly tapers narrowingly to a first portion, then to an outwardly uniformly tapering second portion, with the third portion being an unsymmetrical bulbous portion having an arcuate inner edge, and a relatively flat outer edge, wherein said unsymmetrical portion is bulbous along its interior edge, such that the asymmetrical portion extends beyond the diameter of said first edge along its interior edge but not so along its exterior edge; a fourth portion of a smaller diameter is interposed between the third portion and a fifth portion, said fourth portion tapering outwardly slightly to join the fifth portion.

9. The crutch of claim 1 wherein the height adjustment fastener comprises a tubular member having a disc washer on its underside of greater diameter than the tubular member, which disc serves as the movement limiting means for said collar; and said collar has an inward extending lip, the opening through said lip being of a lesser diameter than the diameter of said disc of said height adjustment fastener.

10. The crutch of claim 1 wherein the annular cylindrical coupler is threadedly engaged to said base boot's central arm.

11. The crutch of claim 1 wherein the locking means comprises lock nut cooperating with a compression valve, said valve being disposed within said moveable central post.

12. The crutch of claim 1 wherein the central moveable post has a lower end and a rubber foot is disposed thereon.

13. The crutch of claim 1 wherein the locking means is a compression valve comprised of a valve body, a compression sleeve and a lock nut.

14. The crutch of claim 13 further including a valve receiver engaged to said compression valve's valve body and to said moveable central post.

* * * * *